US010415829B2

(12) United States Patent
Mori

(10) Patent No.: US 10,415,829 B2
(45) Date of Patent: Sep. 17, 2019

(54) FLAME DETECTING SYSTEM

(71) Applicant: Azbil Corporation, Tokyo (JP)

(72) Inventor: Raita Mori, Tokyo (JP)

(73) Assignee: Azbil Corporation, Tokyo (JP)

( * ) Notice: Subject to any disclaimer, the term of this patent is extended or adjusted under 35 U.S.C. 154(b) by 0 days.

(21) Appl. No.: 15/997,235

(22) Filed: Jun. 4, 2018

(65) Prior Publication Data

US 2018/0347814 A1 Dec. 6, 2018

(51) Int. Cl.
*F23N 5/08* (2006.01)
*F23N 5/24* (2006.01)

(52) U.S. Cl.
CPC ..... *F23N 5/082* (2013.01); *F23N 5/242* (2013.01); *F23N 2031/10* (2013.01)

(58) Field of Classification Search
CPC ..... G08B 17/12; G08B 29/145; G08B 17/02; G08B 29/20; F23N 2029/08; F23N 2031/10; F23N 2029/00; F23N 5/24; F23N 5/082; G01J 1/0228; G01J 5/0014
See application file for complete search history.

(56) References Cited

U.S. PATENT DOCUMENTS

2002/0014486 A1* 2/2002 Chun ..... G07C 3/04 219/702
2005/0247883 A1* 11/2005 Burnette ..... G01J 1/429 250/372

FOREIGN PATENT DOCUMENTS

JP 2011-141290 A 7/2011
JP 2013-210284 A 10/2013

* cited by examiner

*Primary Examiner* — Kenneth J Malkowski
(74) *Attorney, Agent, or Firm* — Amster, Rothstein & Ebenstein LLP

(57) ABSTRACT

A current discharge probability of a flame sensor is calculated based on the number of drive pulses applied to the flame sensor and the number of discharges determined to have occurred in the flame sensor after receiving the drive pulses. Degradation indices (degradation progress and remaining lifetime) indicating the current degradation state of the flame sensor are calculated based on the calculated current discharge probability of the flame sensor.

5 Claims, 4 Drawing Sheets

FLAME DETECTING SYSTEM

CROSS-REFERENCE TO RELATED APPLICATIONS

The present application claims the benefit of and priority to Japanese Patent Application No. JP 2017-111565, filed on Jun. 6, 2017, the entire contents of which are incorporated by reference herein.

TECHNICAL FIELD

The present invention relates to a flame detecting system that detects the presence or absence of a flame.

BACKGROUND

There is a conventionally known electron tube used to detect the presence or absence of a flame on the basis of ultraviolet rays emitted from a flame in a combustion furnace or the like. The electron tube includes a sealed container in which predetermined gas is filled in a sealing manner, two electrode supporting pins that penetrate through both end portions of the sealed container, and two electrodes (a pair of electrodes) that are supported in parallel with each other by the electrode supporting pins within the sealed container.

In the electron tube, when one electrode facing a flame is irradiated with ultraviolet rays in a state where a predetermined voltage is applied across the electrodes through the electrode supporting pins, electrons are emitted from the one electrode due to the photoelectric effect and excited in succession one after another to cause an electron avalanche between the one electrode and the other electrode. Therefore, it is possible to detect the presence or absence of a flame by measuring a change in impedance between the electrodes, a change in voltage between the electrodes, a change in current flowing between the electrodes, and the like. Various methods for detecting the presence or absence of a flame have been suggested (see PTL 1 and PTL 2, for example).

CITATION LIST

Patent Literature

[PTL 1] JP-A-2011-141290
[PTL 2] JP-A-2013-210284

SUMMARY

Such a flame detecting system is often used to detect the presence or absence of a flame in a high-temperature furnace and the above electron tube is used as a flame sensor that detects light emitted from a flame.

However, when a flame sensor degrades and cannot detect the presence or absence of a flame accurately during operation of a high-temperature furnace in such a site, an unforeseeable situation may be caused. Therefore, such a problem is conventionally addressed by uniform lifetime management, such as replacement of the flame sensor every several years after the flame sensor starts operating, and operational management, such as a periodical inspection.

The invention addresses the above problem with an object of providing a flame detecting system that can know an appropriate replacement time of a flame sensor.

To achieve the above object, according to the invention, there is provided a flame detecting system comprising a flame sensor (1) configured to have a pair of electrodes and detect light generated from a flame; an applied voltage generating portion (12) configured to periodically generate a pulsed voltage and apply the voltage across the pair of electrodes of the flame sensor as drive pulses; a current detecting portion (15) configured to detect current flowing through the flame sensor; a number-of-discharges counting portion (201) configured to count the number of discharges determined to have occurred across the pair of electrodes of the flame sensor based on the current detected by the current detecting portion when the drive pulses generated by the applied voltage generating portion are applied across the pair of electrodes of the flame sensor; a discharge probability calculating portion (202) configured to calculate a current discharge probability of a discharge occurring between the pair of electrodes of the flame sensor based on the number of pulses of the drive pulses applied across the pair of electrodes of the flame sensor by the applied voltage generating portion and the number of discharges counted by the number-of-discharges counting portion when the drive pulses are applied across the pair of electrodes of the flame sensor; and a degradation index calculating portion (22) configured to calculate a degradation index indicating a current degradation state of the flame sensor based on the current discharge probability calculated by the discharge probability calculating portion.

In the invention, the pulsed voltage is periodically applied across the pair of electrodes of the flame sensor as drive pulses. The discharge probability calculating portion calculates the current discharge probability ($P=n/N$) of a discharge occurring between the pair of electrodes of the flame sensor based on the number ($N$) of drive pulses applied across the pair of electrodes of the flame sensor and the number ($n$) of discharges determined to have occurred when the drive pulses are applied across the pair of electrodes of the flame sensor.

Degradation of the flame sensor is thought to be caused mainly because the electrode surface from which electrons are emitted becomes rough as the flame sensor operates and electrodes are not easily emitted. In the invention, the discharge probability of the flame sensor reduces as the flame sensor degrades. Accordingly, in the invention, a degradation index indicating the current degradation state of the flame sensor is calculated based on the current discharge probability calculated by the discharge probability calculating portion. For example, the degradation progress of the flame sensor is calculated or the remaining lifetime of the flame sensor is calculated as a degradation index.

In the above description, the components in the drawings corresponding to components of the invention are indicated by reference numerals enclosed in parentheses as an example.

As described above, according to the invention, since the current discharge probability of a discharge occurring across the pair of electrodes of the flame sensor is calculated based on the number of pulses of drive pulses applied across the pair of electrodes of the flame sensor and the number of discharges determined to have occurred when the drive pulses are applied across the pair of electrodes of the flame sensor and the degradation index indicating the current degradation state of the flame sensor is calculated based on the calculated current discharge probability, the appropriate replacement time of the flame sensor can be known by, for example, calculating the degradation progress of the flame sensor or calculating the remaining lifetime of the flame sensor.

DETAILED DESCRIPTION

Figure 1:
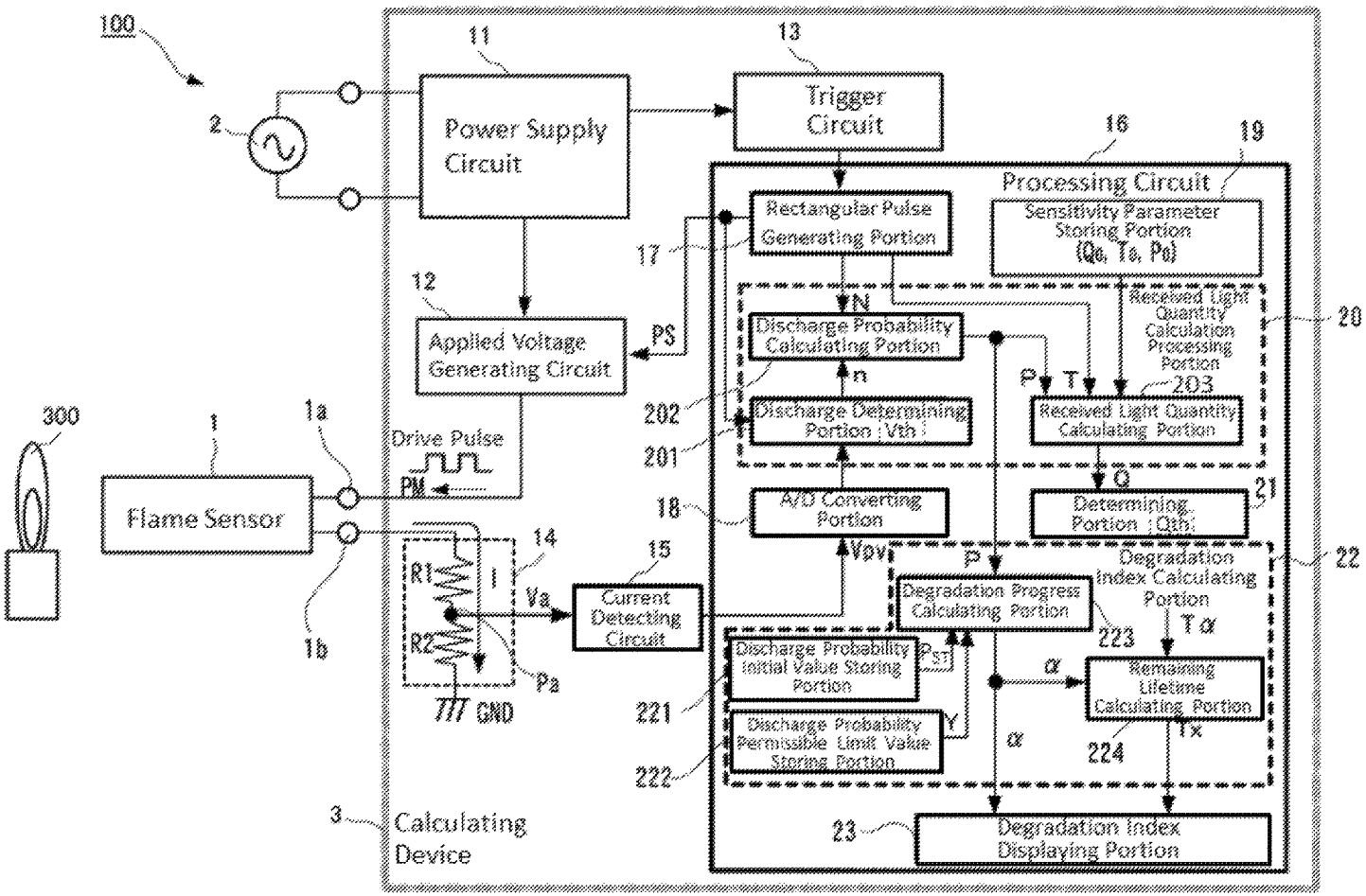
FIG. 1 illustrates the main part of a flame detecting system according to an embodiment of the invention.

An embodiment of the invention will be described in detail below with reference to the drawings. FIG. 1 illustrates the main part of a flame detecting system 100 according to an embodiment of the invention. The flame detecting system 100 comprises a flame sensor 1, an external power supply 2, and a calculating device 3 to which the flame sensor 1 and the external power supply 2 are connected.

Although not illustrated, the flame sensor 1 has an electron tube comprising a cylindrical envelope whose both end portions are closed, two electrode pins that penetrate through the both end portions of the envelope, and two electrodes (a pair of electrodes) that are supported in parallel with each other by the electrode pins within the envelope.

In such an electron tube, one electrode is disposed so as to face a device such as a burner which generates a flame 300. With this, when one electrode is irradiated with ultraviolet rays in a state where a predetermined voltage is applied across the electrodes, electrons are emitted from the electrode due to the photoelectric effect and excited in succession one after another to cause an electron avalanche between one electrode and the other electrode. This changes the voltage, current, and impedance between the electrodes.

The external power supply 2 is configured by a commercial AC power supply having a voltage value of, for example, 100 V or 200 V.

The calculating device 3 comprises a power supply circuit 11 connected to the external power supply 2, an applied voltage generating circuit 12 and a trigger circuit 13 connected to the power supply circuit 11, a voltage dividing resistor 14 comprising resistors R1 and R2 connected in series between a downstream side terminal 1*b* of the flame sensor 1 and a ground line GND, a current detecting circuit 15 for detecting a voltage (reference voltage) Va generated at a connection point Pa between the resistors R1 and R2 of the voltage dividing resistor 14 as current I flowing through the flame sensor 1, and a processing circuit 16 to which the applied voltage generating circuit 12, the trigger circuit 13, and the current detecting circuit 15 are connected.

The power supply circuit 11 supplies AC electric power input from the external power supply 2 to the applied voltage generating circuit 12 and the trigger circuit 13. In addition, the electric power for driving the calculating device 3 is obtained from the power supply circuit 11 (however, the electric power for driving the calculating device 3 may be obtained from another power supply regardless of whether the electric power is AC power or DC power).

Figure 2:
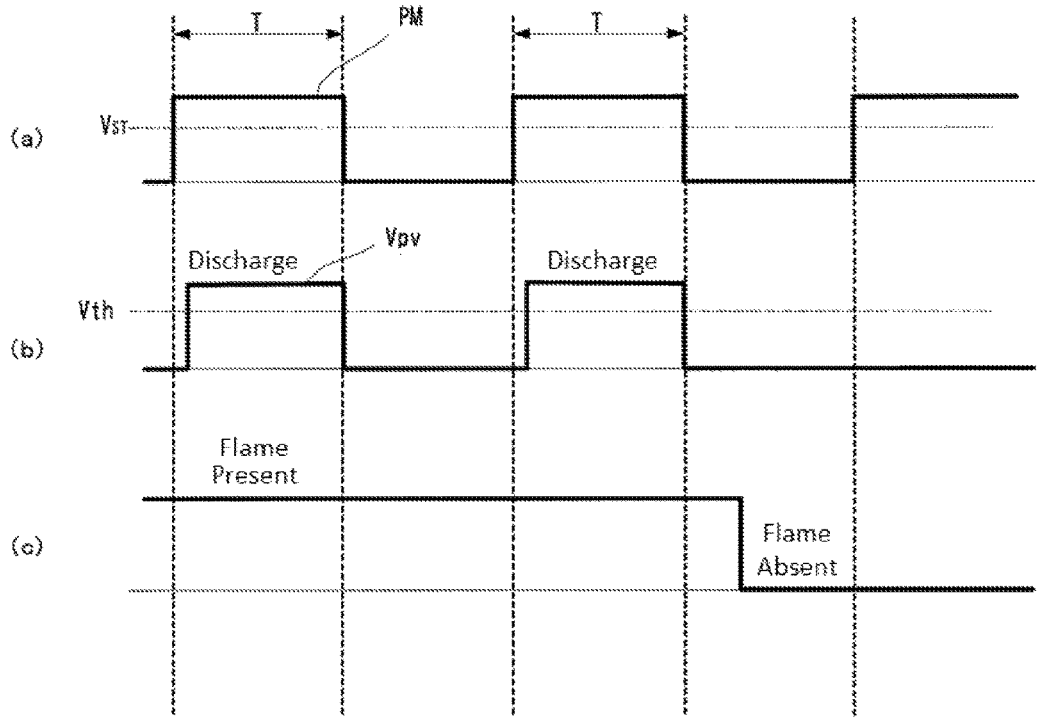
FIG. 2 is a waveform diagram illustrating drive pulses PM applied to a flame sensor, a detected voltage Vpv detected in a current detecting circuit, and the presence or absence of a flame in the flame detecting system illustrated in FIG. 1.

The applied voltage generating circuit 12 boosts the AC voltage applied by the power supply circuit 11 to a predetermined value and applies the boosted AC voltage to the flame sensor 1. In an embodiment, applied voltage generating circuit 12 generates a 200 V pulsed voltage (voltage equal to or more than a discharge starting voltage $V_{ST}$ of the flame sensor 1) in sync with rectangular pulses PS from the processing circuit 16 as drive pulses PM and applies the generated drive pulses PM to the flame sensor 1. FIG. 2(*a*) illustrates the drive pulses PM to be applied to the flame sensor 1. The drive pulses PM synchronize with the rectangular pulses PS from the processing circuit 16 and a pulse width T thereof is equal to the pulse width of the rectangular pulses PS. The rectangular pulses PS from the processing circuit 16 will be described later.

The trigger circuit 13 detects a predetermined value point of the AC voltage applied by the power supply circuit 11 and inputs the detected result to the processing circuit 16. In an embodiment, the trigger circuit 13 detects the minimum value point at which the voltage value is minimized as a predetermined value point (triggering time point). By detecting a predetermined value point regarding an AC voltage in this manner, it is possible to detect one cycle of the AC voltage.

The voltage dividing resistor 14 generates the reference voltage Va as a divided voltage by the resistors R1 and R2 and inputs the reference voltage Va to the current detecting circuit 15. Since the voltage value of the drive pulses PM applied to an upstream side terminal 1*a* of the flame sensor 1 is a high voltage of 200 V as described above, if the voltage generated at the terminal 1*b* downstream of the flame sensor 1 is input to the current detecting circuit 15 as is when current flows between the electrodes of the flame sensor 1, a heavy load is applied to the current detecting circuit 15. Accordingly, in the embodiment, the voltage dividing resistor 14 generates the reference voltage Va having a low voltage value and inputs the reference voltage Va to the current detecting circuit 15.

The current detecting circuit 15 detects the reference voltage Va input from the voltage dividing resistor 14 as the current I flowing through the flame sensor 1 and inputs the detected reference voltage Va to the processing circuit 16 as a detected voltage Vpv.

The processing circuit 16 includes a rectangular pulse generating portion 17, an A/D converting portion 18, a sensitivity parameter storing portion 19, a received light quantity calculation processing portion 20, a determining portion 21, a degradation index calculating portion 22, and a degradation index displaying portion 23.

The rectangular pulse generating portion 17 generates the rectangular pulse PS having the pulse width T each time the trigger circuit 13 detects a triggering time point (that is, every cycle of an AC voltage applied from the power supply circuit 11 to the trigger circuit 13). The rectangular pulses PS generated by the rectangular pulse generating portion 17 are sent to the applied voltage generating circuit 12.

The A/D converting portion 18 performs A/D conversion of the detected voltage Vpv from the current detecting circuit 15 and sends the converted voltage to the received light quantity calculation processing portion 20. The sensitivity parameter storing portion 19 stores, as the known sensitivity parameters owned by the flame sensor 1, a reference received light quantity $Q_0$, a reference pulse width $T_0$, and a reference discharge probability $P_0$, which will be described later.

Each of the received light quantity calculation processing portion 20 and the degradation index calculating portion 22 are achieved by hardware including a processor and a memory device and programs achieving various functions in cooperation with such hardware, the received light quantity calculation processing portion 20 comprises a discharge determining portion 201, a discharge probability calculating portion 202, and a received light quantity calculating portion 203, and the degradation index calculating portion 22 comprises a discharge probability initial value storing portion 221, a discharge probability permissible limit value storing portion 222, a degradation progress calculating portion 223, and a remaining lifetime calculating portion 224.

<<Received Light Quantity Calculation Processing Portion>>

In the received light quantity calculation processing portion 20, the discharge determining portion 201 compares the detected voltage Vpv input from the A/D converting portion 18 with a predetermined threshold voltage Vth (see FIG. 2(*b*)) each time the drive pulse PM is applied to the flame sensor 1 (each time the rectangular pulse PS is generated) and, when the detected voltage Vpv exceeds the threshold voltage Vth, determines that the flame sensor 1 has discharged.

The discharge probability calculating portion 202 obtains the number n of discharges determined to have occurred by the discharge determining portion 201 each time the number of pulses of the drive pulses PM applied to the flame sensor 1 reaches N (each time the number of pulses of the rectangular pulses PS reaches N) and calculates a discharge probability P (P=n/N) of the flame sensor 1 based on the obtained number n of discharges and the number N of pulses of the drive pulses PM applied to the flame sensor 1.

The received light quantity calculating portion 203 calculates a received light quantity Q per unit time received by the flame sensor 1 using Equation 7, which will be described later, based on the known sensitivity parameters (the reference received light quantity $Q_0$, the reference pulse width $T_0$, and the reference discharge probability $P_0$) stored in the sensitivity parameter storing portion 19, the pulse width T (pulse width T of the rectangular pulses PS) of the drive pulse PM applied to the flame sensor 1, and the discharge probability P (P=n/N) computed by the discharge probability calculating portion 202.

It should be noted that the calculation of the received light quantity Q with Equation 7 is performed when the discharge probability P is 0<P<1. When the discharge probability P is 0, the received light quantity Q is 0. When the discharge probability P is 1, such processing does not apply.

The received light quantity Q calculated by the received light quantity calculating portion 203 is sent to the determining portion 21. The determining portion 21 compares the received light quantity Q from the received light quantity calculating portion 203 with a predetermined threshold Qth and, when the received light quantity Q exceeds the threshold Qth, determines that a flame is present.

<<About Sensitivity Parameter>>

It is assumed that the probability that discharge occurs when a single photon collides with the flame sensor 1 is $P_1$ and the probability that discharge occurs when two photons collide with the flame sensor 1 is $P_2$. Since $P_2$ is the inverse of the probability that discharge does not occur due to the first photon and the second photon, the relationship between $P_1$ and $P_2$ is expressed as Equation 1 below.

$$(1-P_2)=(1-P_1)^2 \tag{1}$$

In general, when it is assumed that the probability that discharge occurs when n photons collide is $P_n$ and the probability that discharge occurs when m photons collide is $P_m$, Equation 2 and Equation 3 are established similarly to Equation 1.

$$(1-P_n)=(1-P_1)^n \tag{2}$$

$$(1-P_m)=(1-P_1)^m \tag{3}$$

The following Equations 4 and 5 representing the relationship between $P_n$ and $P_m$ are drawn based on Equations 2 and 3.

$$(1-P_n)^{\frac{1}{n}}=(1-P_m)^{\frac{1}{m}} \tag{4}$$

$$(1-P_n)=(1-P_m)^{\frac{n}{m}} \tag{5}$$

The number of photons contributing to discharge is determined by the product of the number Q of photons (received light quantity per unit time) that reach the electrodes of the flame sensor 1 per unit time and time T (pulse width T) for which a voltage equal to or more than the discharge starting voltage $V_{ST}$ is applied to the flame sensor 1. When the reference received light quantity $Q_0$ and the reference pulse width $T_0$ are determined and the discharge probability at this time is defined as $P_0$, the light quantity Q, the pulse width T, and the discharge probability P at that time are represented by Equation 6 below.

$$(1-P)=(1-P_0)^{\frac{QT}{Q_0T_0}} \tag{6}$$

Based on Equation 6, the received light quantity Q per unit time received by the flame sensor 1 can be calculated using Equation 7 below.

$$Q=\frac{Q_0\cdot T_0}{T}\log_{(1-P_0)}(1-P) \tag{7}$$

In Equation 7, since the pulse width T is the pulse width (pulse width of the rectangular pulses PS) of the drive pulses PM applied to the flame sensor 1 and known, if the reference received light quantity $Q_0$, the reference pulse width $T_0$, and the reference discharge probability $P_0$ are known, the unknown numbers are the received light quantity Q and the discharge probability P that are being measured.

Accordingly, in an embodiment, the received light quantity Q per unit time received by the flame sensor 1 is calculated by applying the N drive pulses PM to the flame sensor 1, making a decision as to whether the flame sensor 1 has discharged for each of the N drive pulses PM, calculating the discharge probability P as P=n/N based on the number N of pulses of the drive pulses PM having been applied to the flame sensor 1 and the number n of times (number of discharges determined to have occurred) the flame sensor 1 has discharged by receiving the drive pulses PM, and substituting the calculated discharge probability P, the known reference received light quantity $Q_0$, the known reference pulse width $T_0$, the known reference discharge probability $P_0$, and the pulse width T into Equation 7.

The reference received light quantity $Q_0$, the reference pulse width $T_0$, and the reference discharge probability $P_0$ need to be measured by, for example, delivery inspection. Then, the reference received light quantity $Q_0$, the reference pulse width $T_0$, and the reference discharge probability $P_0$ that have been measured are stored in the sensitivity parameter storing portion 19 in advance as the known sensitivity parameters of the flame sensor 1.

<<Degradation Index Calculating Portion>>

Figure 3:
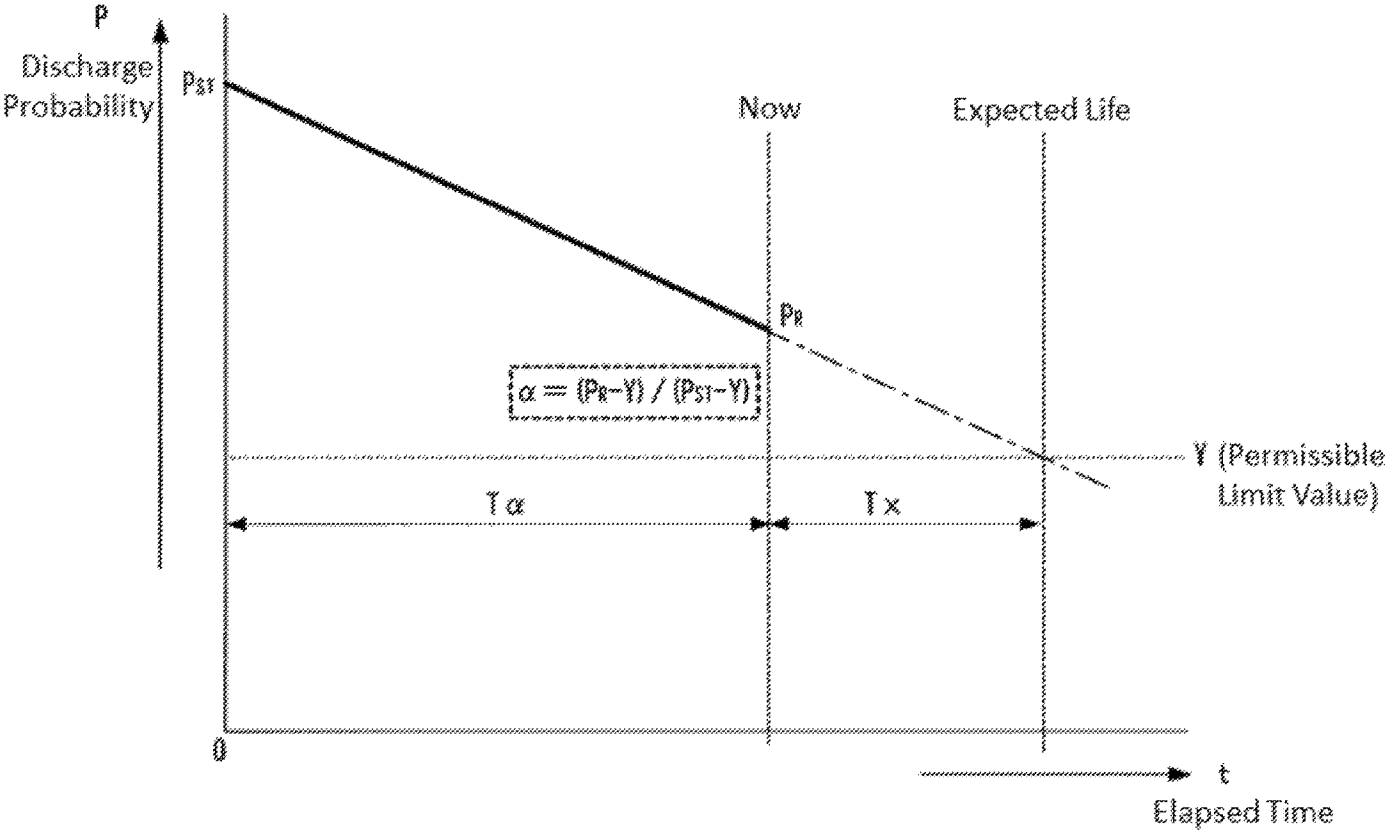
FIG. 3 is a graph that illustrates how a discharge probability of the flame sensor reduces with the passage of time.

In the degradation index calculating portion 22, the discharge probability initial value storing portion 221 stores an initial value $P_{ST}$ of the discharge probability of the flame sensor 1 and the discharge probability permissible limit value storing portion 222 stores a permissible limit value Y of the discharge probability of the flame sensor 1. Degradation of the flame sensor 1 is thought to be caused mainly because the electrode surface from which electrons are emitted becomes rough as the flame sensor 1 operates and electrodes are not easily emitted. In this case, the discharge probability P of the flame sensor 1 reduces as the flame sensor 1 degrades (see FIG. 3).

In an embodiment, the discharge probability P when the flame sensor 1 starts operating is stored in the discharge probability initial value storing portion 221 as the initial value $P_{ST}$ of the discharge probability and the discharge probability P when the lifetime of the flame sensor 1 is expected to end is stored in the discharge probability permissible limit value storing portion 222 as the permissible limit value Y.

In the degradation index calculating portion 22, the degradation progress calculating portion 223 calculates degradation progress α of the flame sensor 1 by substituting the initial value $P_{ST}$ of the discharge probability stored in the discharge probability initial value storing portion 221, the permissible limit value Y of the discharge probability stored in the discharge probability permissible limit value storing portion 222, and the current discharge probability $P(P_R)$ calculated by the discharge probability calculating portion 202 into Equation 8 below.

$$\alpha=(P_R-Y)/(P_{ST}-Y) \tag{8}$$

In the degradation index calculating portion 22, the remaining lifetime calculating portion 224 calculates a remaining lifetime Tx of the flame sensor 1 by substituting the degradation progress α of the flame sensor 1 calculated by the degradation progress calculating portion 223 and an elapsed time Tα after the flame sensor 1 has started operating into Equation 9 below.

$$Tx=(\alpha-T\alpha)/(1-\alpha) \tag{9}$$

The degradation progress α of the flame sensor 1 obtained by the degradation progress calculating portion 223 and the remaining lifetime Tx of the flame sensor 1 obtained by the remaining lifetime calculating portion 224 are sent to the degradation index displaying portion 23. The degradation index displaying portion 23 displays, on a screen, the degradation progress α sent from the degradation progress calculating portion 223 as a first degradation index and the remaining lifetime Tx sent from the remaining lifetime calculating portion 224 as a second degradation index.

Since the degradation progress α and the remaining lifetime Tx of the flame sensor 1 are displayed as the degradation indices indicating the current degradation state of the flame sensor 1 in an embodiment as described above, the appropriate replacement time of the flame sensor 1 can be known. In this case, by displaying the degradation progress α and the remaining lifetime Tx together with the graph representing the relationship between the discharge probability P and an elapsed time t illustrated in FIG. 3, the operator's understanding is further improved.

<<Detection of Presence or Absence of a Flame and Displaying of a Degradation Index>>

Figure 4:
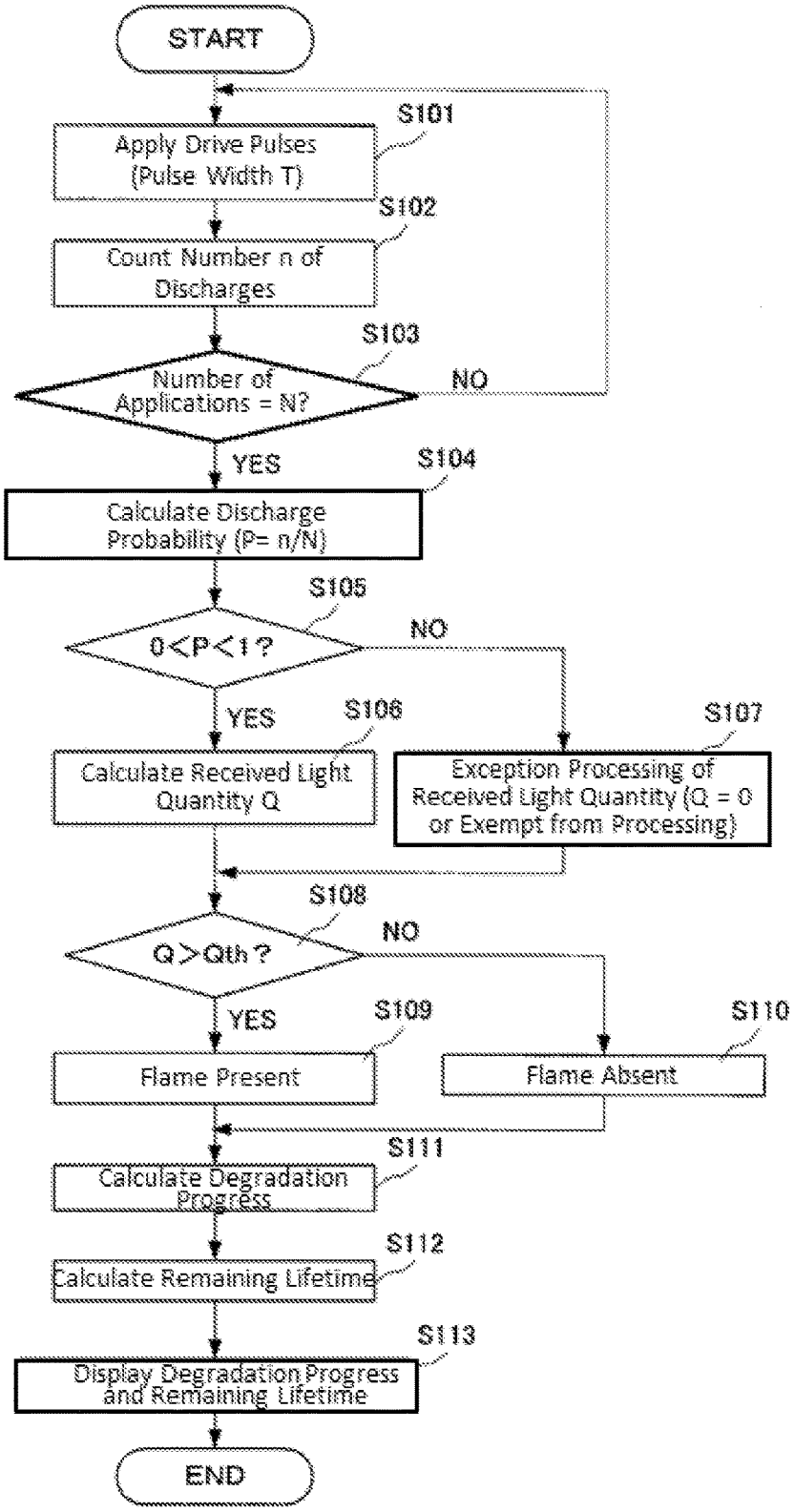
FIG. 4 is a flowchart illustrating an operational process of detecting the presence or absence of a flame and determining and displaying a degradation index in the flame detecting system.

An operational process of detecting the presence or absence of a flame and determining and displaying the degradation index, as described above in the flame detecting system 100, will be described with reference to the flowchart illustrated in FIG. 4.

When the trigger circuit 13 detects a triggering time point, the rectangular pulse generating portion 17 generates the rectangular pulse PS and sends the generated rectangular pulse PS to the applied voltage generating circuit 12. With this, the applied voltage generating circuit 12 generates the drive pulse PM having the same pulse width T as the rectangular pulse PS and the generated drive pulse PM having the pulse width T is applied to the flame sensor 1 (step S101).

When the drive pulse PM (voltage equal to or more than the discharge starting voltage $V_{ST}$) has been applied to the flame sensor 1 and the current I has flowed between the electrodes of the flame sensor 1, the current I having flowed between the electrodes of the flame sensor 1 is detected by the current detecting circuit 15 as the detected voltage Vpv and sent to the discharge determining portion 201 via the A/D converting portion 18.

The discharge determining portion 201 compares the detected voltage Vpv from the current detecting circuit 15 with the predetermined threshold voltage Vth and, when the detected voltage Vpv exceeds the threshold voltage Vth, determines that the flame sensor 1 has discharged. When determining that the flame sensor 1 has discharged, the discharge determining portion 201 increments the number n of discharges by 1 (step S102).

Application of the drive pulses PM to the flame sensor 1 in step S101 and counting of the number n of discharges in the flame sensor 1 in step S102 are repeated until the number of applications of the drive pulses PM to the flame sensor 1 reaches the predetermined number N of times.

Then, when the number of applications of the drive pulses PM to the flame sensor 1 reaches N (YES in step S103), the discharge probability calculating portion 202 obtains the number n of discharges counted by the discharge determining portion 201 and calculates the discharge probability P (P=n/N) of the flame sensor 1 based on the obtained number n of discharges and the number N of applications of the drive pulses PM to the flame sensor 1 (step S104).

The discharge probability P calculated by the discharge probability calculating portion 202 is sent to the received light quantity calculating portion 203. The received light quantity calculating portion 203 determines whether the discharge probability P meets 0<P<1 and, when the discharge probability P meets 0<P<1 (YES in step S105), calculates the received light quantity Q using Equation 7 above (step S106).

That is, the received light quantity Q per unit time received by the flame sensor 1 is calculated based on the known sensitivity parameters (the reference received light quantity $Q_0$, the reference pulse width $T_0$, and the reference discharge probability $P_0$) stored in the sensitivity parameter storing portion 19, the pulse width T of the drive pulses PM applied to the flame sensor 1, and the discharge probability P (P=n/N) computed by the discharge probability calculating portion 202.

In contrast, when the discharge probability P does not meet 0<P<1 (NO in step S105), that is, when the discharge probability P is 0 or 1, the received light quantity calculating portion 203 performs the exception processing of received light quantity (step S107). In the exception processing of received light quantity, the received light quantity Q is set to 0 when the discharge probability P is 0 or such processing does not apply when the discharge probability P is 1.

The received light quantity Q calculated by the received light quantity calculating portion 203 is sent to the determining portion 21. The determining portion 21 compares the received light quantity Q from the received light quantity calculating portion 203 with the predetermined threshold Qth and, when the received light quantity Q exceeds the threshold Qth (YES in step S108), determines that a flame is present (step S109). When the received light quantity Q does not exceed the threshold Qth (NO in step S108), the determining portion 21 determines that a flame is not present (step S110).

In addition, the current discharge probability P ($P_R$) calculated by the discharge probability calculating portion 202 is sent to the degradation progress calculating portion 223. The degradation progress calculating portion 223 calculates the degradation progress α of the flame sensor 1 based on the initial value $P_{ST}$ of the discharge probability, the permissible limit value Y of the discharge probability, and the current discharge probability $P_R$ (step S111). The degradation progress α calculated by the degradation progress calculating portion 223 is sent to the remaining lifetime calculating portion 224. The remaining lifetime calculating portion 224 calculates the remaining lifetime Tx of the flame sensor 1 based on the degradation progress α of the flame sensor 1 and the elapsed time Tα after the flame sensor 1 has started operating (step S112).

The degradation progress α of the flame sensor 1 obtained by the degradation progress calculating portion 223 and the remaining lifetime Tx of the flame sensor 1 obtained by the remaining lifetime calculating portion 224 are sent to the degradation index displaying portion 23. The degradation index displaying portion 23 displays, on a screen, the degradation progress α sent from the degradation progress calculating portion 223 as the first degradation index and the remaining lifetime Tx sent from the remaining lifetime calculating portion 224 as the second degradation index (step S113).

Although the drive pulses PM generated by the applied voltage generating circuit 12 are based on the rectangular pulses PS generated by the rectangular pulse generating portion 17 and the number N of pulses and the pulse width T of the rectangular pulses PS are used as the number N of pulses and the pulse width T of the drive pulses PM in the above embodiment, the number N of pulses and the pulse width T of the actual drive pulses PM generated by the applied voltage generating circuit 12 may be used.

In addition, although the degradation progress α and the remaining lifetime Tx are obtained as the degradation indices indicating the current degradation state of the flame sensor 1 in the embodiment described above, only the degradation progress α may be obtained or only the remaining lifetime Tx may be obtained. In this case, the remaining lifetime Tx may be obtained by Equation 10 below without obtaining the degradation progress α.

$$(P_R-Y)\cdot T\alpha/(P_{ST}-P_R) \tag{10}$$

In addition, although the flame detecting system that detects the presence or absence of a flame based on the received light quantity per unit time received by the flame sensor is used as an example in the embodiment described above, the invention is also applicable to a flame detecting system that detects the presence or absence of a flame using another method.

<<Extension of the Embodiment>>

Although the invention has been described with reference to the above embodiment, the invention is not limited to the above embodiment. Various changes understandable to those skilled in the art can be made to the structure and details of the invention within the technical spirit of the invention.

For example, shutter functionality can be provided on the envelope of the flame sensor for use in a flame detecting system for detecting a pseudo flame. Even when such modification is made in a matter of design, the modification is also included in the scope of the invention.

For example, although the external power supply 2 is an AC commercial power source as illustrated in FIG. 1 in the above embodiment, a DC power source may be used instead. In this case, the power supply circuit 11 applies a DC voltage having a predetermined voltage value to the applied voltage generating circuit 12 and the trigger circuit 13, the trigger circuit 13 applies a DC voltage having a predetermined rectangular waveform to the rectangular pulse generating portion 17 by turning on and off the applied DC voltage at predetermined cycles, and the rectangular pulse generating portion 17 may be configured so as to generate the rectangular pulses PS from the DC voltage having a rectangular waveform and output the generated rectangular pulses PS.

In addition, the concept of an effective electrode surface area may be introduced to the flame sensor. Then, it is possible to calculate the brightness of the flame by dividing the received light quantity by the effective electrode surface area. The effective electrode surface area means the area on which light impinges of the electrode surface area of the flame sensor and the effective electrode surface area is a parameter unique to the flame sensor.

DESCRIPTION OF REFERENCE NUMERALS AND SIGNS

1: flame sensor, 2: external power supply, 3: calculating device, 11: power supply circuit, 12: applied voltage generating circuit, 13: trigger circuit, 14: voltage dividing resistor, 15: current detecting circuit, 16: processing circuit, 17: rectangular pulse generating portion, 18: A/D converting portion, 19: sensitivity parameter storing portion, 20: received light quantity calculation processing portion, 21: determining portion, 22: degradation index calculating portion, 23: degradation index displaying portion, 100: flame detecting system, 201: discharge determining portion, 202: discharge probability calculating portion, 203: received light quantity calculating portion, 221: discharge probability initial value storing portion, 222: discharge probability permissible limit value storing portion, 223: degradation progress calculating portion, 224: remaining lifetime calculating portion, 300: flame

The invention claimed is:

1. A flame detecting system comprising:

a flame sensor configured to have a pair of electrodes and detect light generated from a flame;

an applied voltage generating portion configured to periodically generate a pulsed voltage and apply the generated pulsed voltage across the pair of electrodes of the flame sensor as drive pulses;

a current detecting portion configured to detect a current flowing through the flame sensor;

a number-of-discharges counting portion configured to count a number of discharges determined to have occurred across the pair of electrodes of the flame sensor based on the current detected by the current detecting portion when the drive pulses generated by the applied voltage generating portion are applied across the pair of electrodes of the flame sensor;

a discharge probability calculating portion configured to calculate a current discharge probability of a discharge occurring between the pair of electrodes of the flame sensor based on a number of the drive pulses applied across the pair of electrodes of the flame sensor by the applied voltage generating portion and the number of discharges counted by the number-of-discharges counting portion when the drive pulses are applied across the pair of electrodes of the flame sensor; and a degradation index calculating portion configured to calculate a degradation index indicating a current degradation state of the flame sensor based on the current discharge probability calculated by the discharge probability calculating portion.

2. The flame detecting system according to claim 1, further comprising:

a degradation index displaying portion configured to display the degradation index of the flame sensor calculated by the degradation index calculating portion.

3. A flame detecting system comprising:

a flame sensor configured to have a pair of electrodes and detect light generated from a flame;

an applied voltage generating portion configured to periodically generate a pulsed voltage and apply the generated puked voltage across the pair of electrodes of the flame sensor as drive pulses;

a current detecting portion configured to detect a current flowing through the flame sensor;

a number-of-discharges counting portion configured to count a number of discharges determined to have occurred across the pair of electrodes of the flame sensor based on the current detected by the current detecting portion when the drive pulses generated by the applied voltage generating portion are applied across the pair of electrodes of the flame sensor;

a discharge probability calculating portion configured to calculate a current discharge probability of a discharge occurring between the pair of electrodes of the flame sensor based on a number of the drive pulses applied across the pair of electrodes of the flame sensor by the applied voltage generating portion and the number of discharges counted by the number-of-discharges counting portion when the drive pulses are applied across the pair of electrodes of the flame sensor; and a degradation index calculating portion configured to calculate a first degradation index indicating a current degradation state of the flame sensor based on the current discharge probability calculated by the discharge probability calculating portion, wherein the degradation index calculating portion comprises a discharge probability initial value storing portion that stores an initial discharge probability value of a discharge occurring between the pair of electrodes of the flame sensor, a discharge probability permissible limit value storing portion that stores a permissible limit discharge probability value of a discharge occurring between the pair of electrodes of the flame sensor, and a degradation progress calculating portion configured to calculate degradation progress of the flame sensor as the first degradation index based on the initial discharge probability value stored in the discharge probability initial value storing portion, the permissible limit discharge probability value stored in the discharge probability permissible limit value storing portion, and the current discharge probability calculated by the discharge probability calculating portion.

4. The flame detecting system according to claim 3, wherein the degradation index calculating portion further comprises a remaining lifetime calculating portion configured to calculate a remaining lifetime of the flame sensor as a second degradation index based on the degradation progress of the flame sensor calculated by the degradation progress calculating portion and an elapsed time after the flame sensor has started operating.

5. A flame detecting system comprising:

a flame sensor configured to have a pair of electrodes and detect light generated from a flame;

an applied voltage generating portion configured to periodically generate a pulsed voltage and apply the generated pulsed voltage across the pair of electrodes of the flame sensor as drive pulses;

a current detecting portion configured to detect a current flowing through the flame sensor;

a number-of-discharges counting portion configured to count a number of discharges determined to have occurred across the pair of electrodes of the flame sensor based on the voltage generating portion are applied across the pair of electrodes of the flame sensor;

a discharge probability calculating portion configured to calculate a current discharge probability of a discharge occurring between the pair of electrodes of the flame sensor based on a number of the drive pulses applied across the pair of electrodes of the flame sensor by the applied voltage generating portion and the number of discharges counted by the number-of-discharges counting portion when the drive pulses are applied across the pair of electrodes of the flame sensor; and a degradation index calculating portion configured to calculate a degradation index indicating a current degradation state of the flame sensor based on the current discharge probability calculated by the discharge probability calculating portion, wherein the degradation index calculating portion comprises a discharge probability initial value storing portion that stores an initial discharge probability value of a discharge occurring between the pair of electrodes of the flame sensor, a discharge probability permissible limit value storing portion that stores a permissible limit discharge probability value of a discharge occurring between the pair of electrodes of the flame sensor, and a remaining lifetime calculating portion configured to calculate a remaining lifetime of the flame sensor as the degradation index based on the initial discharge probability value stored in the discharge probability initial value storing portion, the permissible limit discharge probability value stored in the discharge probability permissible limit value storing portion, the current discharge probability calculated by the discharge probability calculating portion, and an elapsed time after the flame sensor has started operating.

* * * * *